US011793267B1

(12) United States Patent
Moudgil et al.

(10) Patent No.: US 11,793,267 B1
(45) Date of Patent: Oct. 24, 2023

(54) SHOE AND THERAPY SYSTEM

(71) Applicant: Pointe People LLC, Chicago, IL (US)

(72) Inventors: Kunal Moudgil, Chicago, IL (US); Victoria Paige Moudgil, Chicago, IL (US); Mark Britton, Santa Barbra, CA (US)

( * ) Notice: Subject to any disclaimer, the term of this patent is extended or adjusted under 35 U.S.C. 154(b) by 35 days.

(21) Appl. No.: 17/665,640

(22) Filed: Feb. 7, 2022

Related U.S. Application Data

(60) Provisional application No. 63/147,042, filed on Feb. 8, 2021.

(51) Int. Cl.

| | |
|---|---|
| ***A43B 7/1455*** | (2022.01) |
| ***A43B 3/24*** | (2006.01) |
| ***A43B 21/24*** | (2006.01) |
| ***A43B 7/00*** | (2006.01) |
| ***A43B 7/02*** | (2022.01) |
| ***A43B 7/14*** | (2022.01) |

(52) U.S. Cl.
CPC ..... *A43B 7/146* (2013.01); *A43B 3/248* (2013.01); *A43B 7/005* (2013.01); *A43B 7/02* (2013.01); *A43B 7/1495* (2013.01); *A43B 21/24* (2013.01)

(58) Field of Classification Search
CPC ..... A43B 3/248; A43B 3/242; A43B 3/102; A43B 3/24; A43B 23/088; A43B 23/26; A43B 7/146; A43B 7/005; A43B 7/02; A43B 7/00; A43B 7/34; A43B 7/1495; A43B 7/18; A43B 7/19; A43C 11/20
USPC ..... 36/2.6, 105
See application file for complete search history.

(56) References Cited

U.S. PATENT DOCUMENTS

| | | | | | |
|---|---|---|---|---|---|
| 1,894,939 | A * | 1/1933 | Brown | A43B 7/1495 | 36/170 |
| 2,024,766 | A * | 12/1935 | Ingwer | A43B 3/16 | 36/50.1 |
| 4,249,319 | A * | 2/1981 | Yoshida | A61F 7/03 | 36/2.6 |
| 4,345,387 | A * | 8/1982 | Daswick | A43B 13/14 | 36/43 |
| 4,370,818 | A * | 2/1983 | Simoglou | A43B 3/24 | 36/110 |
| 5,127,170 | A * | 7/1992 | Messina | A43B 23/08 | 36/105 |
| 5,651,197 | A * | 7/1997 | James | A43C 11/16 | 36/88 |
| 6,298,583 | B1 * | 10/2001 | Allen | A43B 3/24 | 36/105 |
| 6,367,171 | B1 * | 4/2002 | Burt | A43B 3/24 | 36/105 |
| 8,225,535 | B2 * | 7/2012 | Dillenbeck | A43B 7/144 | 36/105 |

(Continued)

*Primary Examiner* — Ted Kavanaugh
(74) *Attorney, Agent, or Firm* — Aronberg Goldgehn Davis & Garmisa

(57) ABSTRACT

The present shoe and therapy system pertains to a uniquely designed shoe that provides therapeutic benefits to wearers. It includes a fold-down heel portion that is designed to repeatedly fold and straighten such that a wearer may collapse the heel into the interior of the shoe and then wear the shoe while standing on the collapsed heel. The folded down fold-down heel includes a plurality of bumps or ridges positioned to provide acupressure therapy to the wearer when folded down, but the heel may alternately be folded up so that the shoe may be worn in the traditional manner.

21 Claims, 13 Drawing Sheets

(56) References Cited

U.S. PATENT DOCUMENTS

| | | | | |
|---|---|---|---|---|
| 10,568,382 | B2 * | 2/2020 | Hatfield | A43B 11/02 |
| 2006/0185192 | A1 * | 8/2006 | Biancucci | A43B 3/166<br>36/109 |
| 2017/0172248 | A1 * | 6/2017 | Fadil | A43B 7/1464 |
| 2017/0303635 | A1 * | 10/2017 | Kazarian | A43B 7/146 |

* cited by examiner

SHOE AND THERAPY SYSTEM

CROSS REFERENCE

This application claims priority to and incorporates herein by this reference in its entirety and for all purposes U.S. Patent Application Ser. No. 63/147,042 filed on behalf of Kunal Moudgil et al on Feb. 8, 2021.

BACKGROUND

Athletic shoes are widely available. Many are constructed with the performance of specific activities in mind. For example, football, baseball, and soccer all utilize specifically designed cleat athletic shoes, while basketball and trail running each have their own particular shoe structure and performance artist athletes, such as dancers, have special shoes as well.

Despite, and sometimes because of, the special shoes for various activities that the athletes perform in, the shoes cause stress and strain on the athlete's feet. For example, performing in tighter than normal shoes, thin soled shoes, or stiff shoes can give an athlete an edge during a performance, but prolonged periods of activity in such shoes can cause soreness blisters, bruising, contusions, or other foot maladies. Repetitive, challenging motions typically encountered in high-level sporting and aerobic activities can reduce blood flow and cause sore feet in addition to causing major foot issues like inflamed plantar fascia, overstressed toes and bunions, tight Achilles tendons, sore ankles, and even raw/blistered heels. Thus, there is a need for footwear that can be worn by athletes after their performance that provides foot support while also providing therapeutic, recovery benefits.

Additionally, typical shoe uppers have heel portions that cup the heel and Achilles area of the foot with a sturdy support structure, such as a piece of rigid plastic. Other shoes, such as dress shoes, are formed of uniform pieces of material, such as leather. In either case, the heel portion is not designed to fold down and be walked on by a user. If folded, the rigid structures are uncomfortable to walk on and can become permanently deformed thereby ruining the structure of the shoe. In other cases, the material becomes creased and can tear or crack. That precludes the shoes from comfortably allowing for wearing as both a shoe and a sandal and also fails to provide any therapeutic benefits for a wearer. In fact, walking on a traditional heel can cause physical discomfort and promote injury.

SUMMARY

Throughout the specification, wherever practicable, like structures will be identified by like reference numbers. In some figures, components, such as additional seams, stitches, or fasteners have been omitted for clarity in the drawings. Unless expressly stated otherwise, the term "or" means "either or both" such that "A or B" includes A alone, B alone, and both A and B together.

The present shoe device is a footwear system that enables athletes (including but not limited to dancers, gymnasts, skaters, etc.) to relieve their feet after workouts and performances that require constant and active use of their feet. The present device combines various relief elements into a cohesive après-workout footwear-relief solution. Embodiments of the shoe may include a heel portion adapted to fold down into the shoe. The foldable heel provides the ability of the athlete to push the heel into the shoe and wear the shoe like a sandal to avoid rubbing of the heel on the Achilles.

Unlike traditional shoes that include structural supports within the heel, the present system is flexible and resilient such that repeated folding and unfolding, and repeatedly experiencing the crushing force of being walked on by the wearer, does not adversely affect the integrity of the heel. The heel may further include points, ribs, ridges or other raised protrusions on the outside of the heel to provide pressure point therapy while walking on the folded heel.

Some embodiments include folding collars along the sides of the upper where the foot is inserted. These folding sections can be folded up for support or folded down to reduce pressure on the ankle.

The unique upper of the shoe includes a strap that encompasses the forefoot. One end of the strap may be attached to the upper, while the length remains unattached such that it is adapted to pass beneath and wrap around the foot. The strap can be relaxed or tightened to encircle and hug the forefoot (essentially around the arch and metatarsals of the foot). Additionally, the toe box may include a pocket that accommodates a thermal pack. The thermal pack may be inserted into the pocket and the strap can be tightened to apply pressure to the pack and hold it against the foot.

DRAWINGS

DETAILED DESCRIPTION

The present shoe is generally in the form of an athletic shoe that would be worn by individuals for walking. However, as will be discussed herein, various structures of the shoe have been modified to provide the unique structure of the present shoe to thereby convey therapeutic benefits to the wearer.

One embodiment of the present shoe includes a unique heel counter. In prior shoes, the heel counter is integrated with the side of the shoe to form the back part of the upper. In prior shoes the counter is generally reinforced, for example, by including a stiff piece of plastic that helps the counter maintain its shape. Bending the counter in such a prior shoe can plastically deform the counter and it cannot be accomplished without further folding and deforming the sides.

Figure 4:
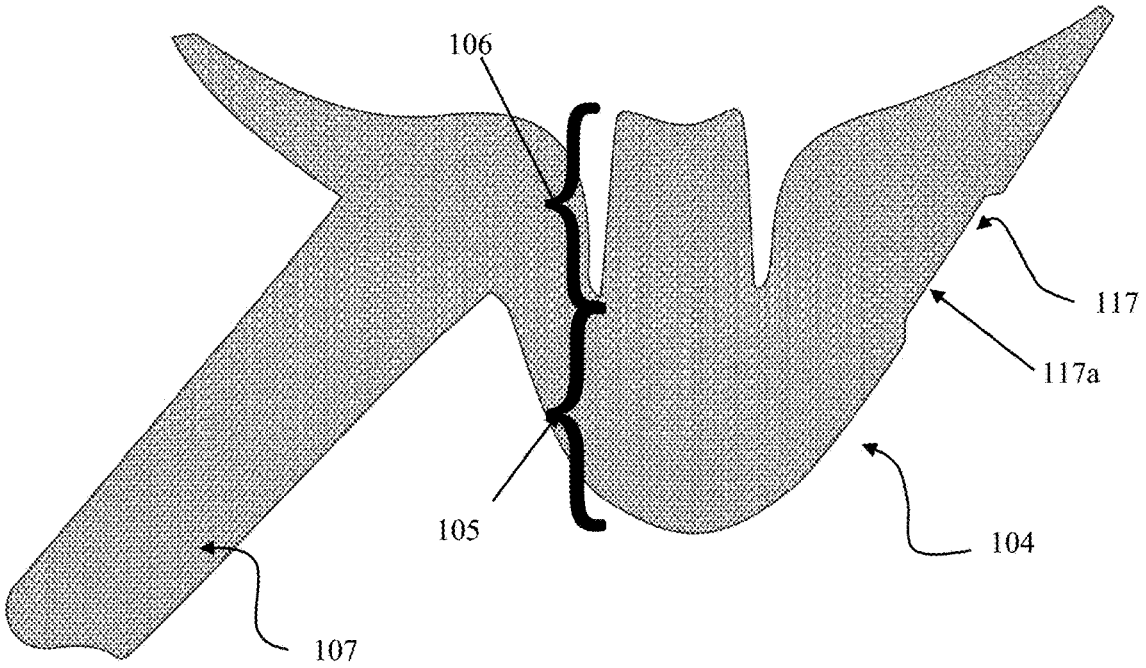
FIG. 4 is a depiction of the top cover with tongue and strap of an embodiment of the present shoe, removed from the shoe and laid flat.
Figure 6:
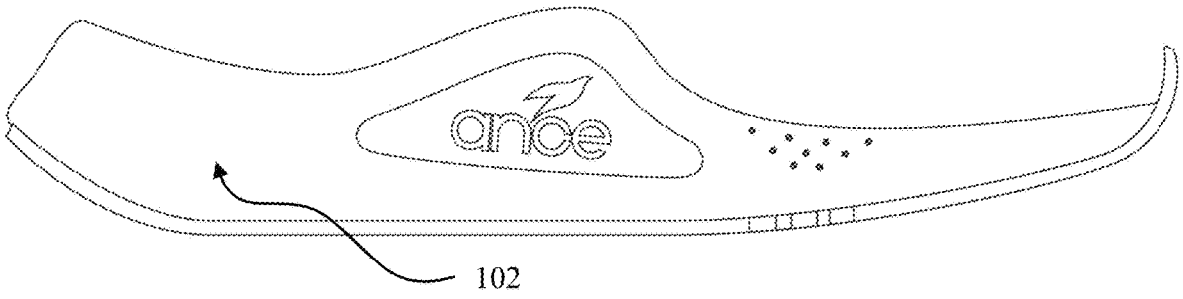
FIG. 6 is a depiction of a side view of the mid-sole of an embodiment of the present shoe.

Referring to FIGS. 1A-1D, the shoe 100 includes an upper 101 connected to a mid-sole 102 having an outsole 103. A depiction of the mid-sole alone is shown in FIG. 6. The mid-sole may generally be divided into three areas, a heal area 118, a mid-foot area 119, and a toe area 120. The upper includes a top cover portion 104 that is at least partially connected to the upper. The top cover 104 includes a toe cover portion 105 that is adapted to cover the toes and a portion of the metatarsals and a tongue portion 106 adapted to cover a portion of the metatarsals and the central cuneiforms. FIG. 4 is a depiction of the top cover portion 104 removed from the shoe and laid flat. The top cover portion 104 further includes a strap 107. The strap is adapted to circle under the insole (not shown), around the arch of the foot, over the metatarsals or cuneiforms, and over or under the tongue portion 106 where it may be secured to the upper. The top cover 104 may further include channel 117. The edge 117*a* is not secured to the upper or mid-sole. Thus, the channel 117 provides a space for the strap to loop under the insole, pass through the seam joining the top cover 104 to the shoe, and wrap around the interior of the foot.

Figure 1A:
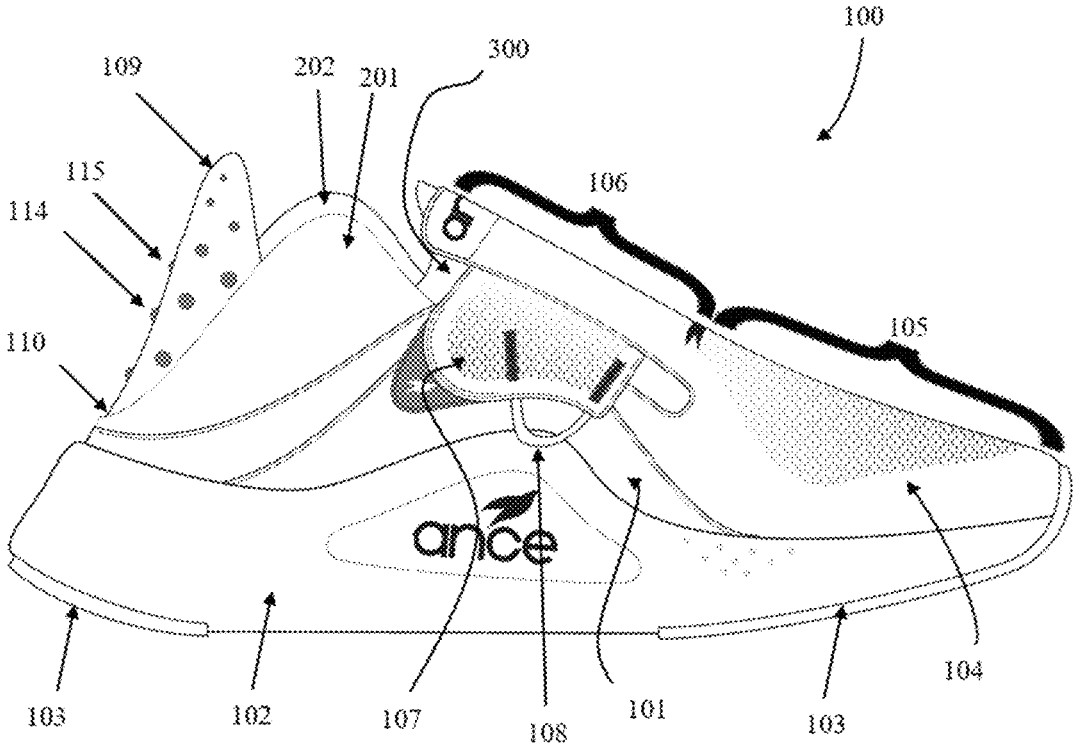
FIG. 1A is a side view of the right side of an embodiment of the present shoe.
Figure 1B:
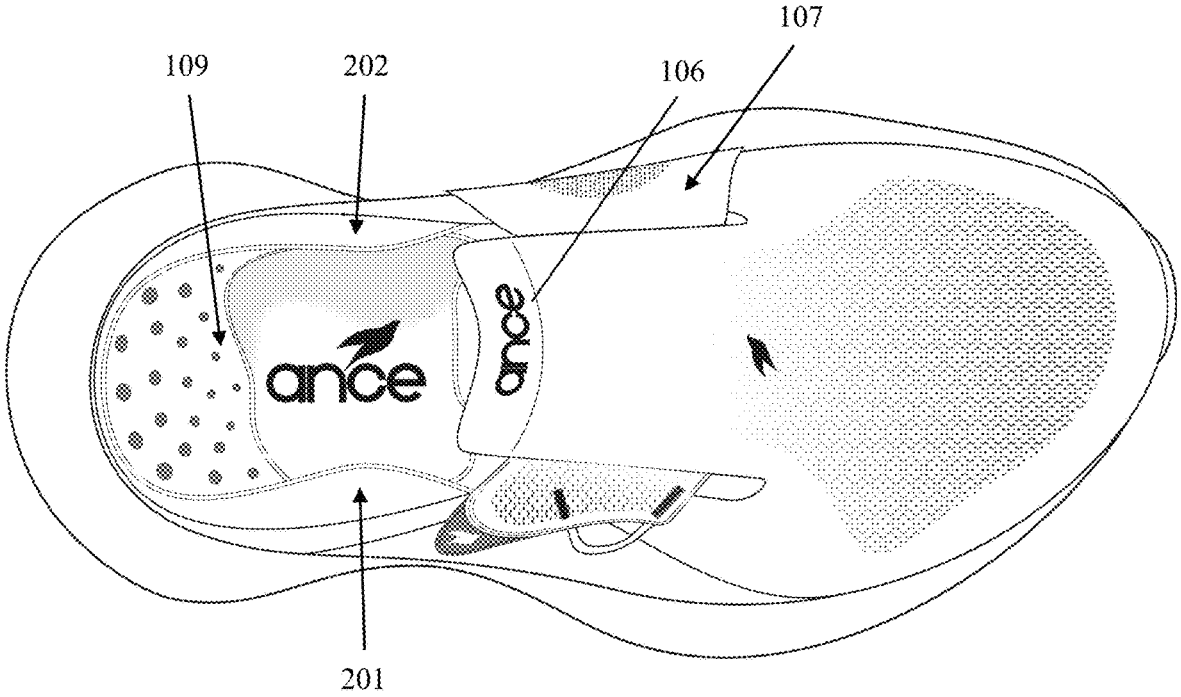
FIG. 1B is a top down view of an embodiment of the present shoe.
Figure 1C:
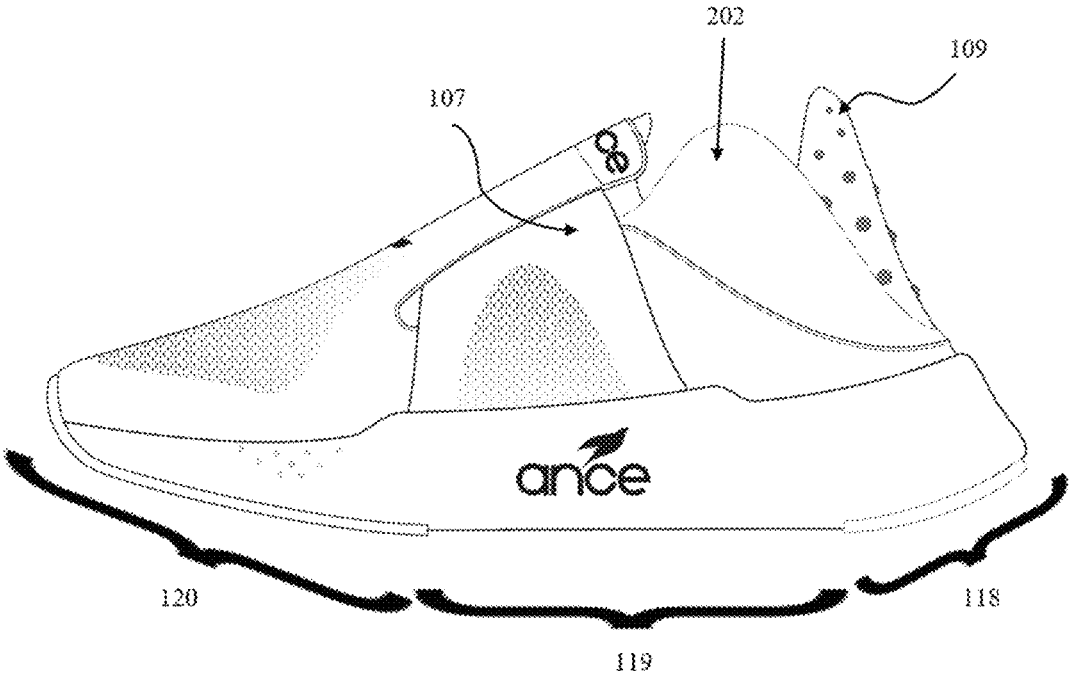
FIG. 1C is a side view of the left side of an embodiment of the present shoe.
Figure 1D:
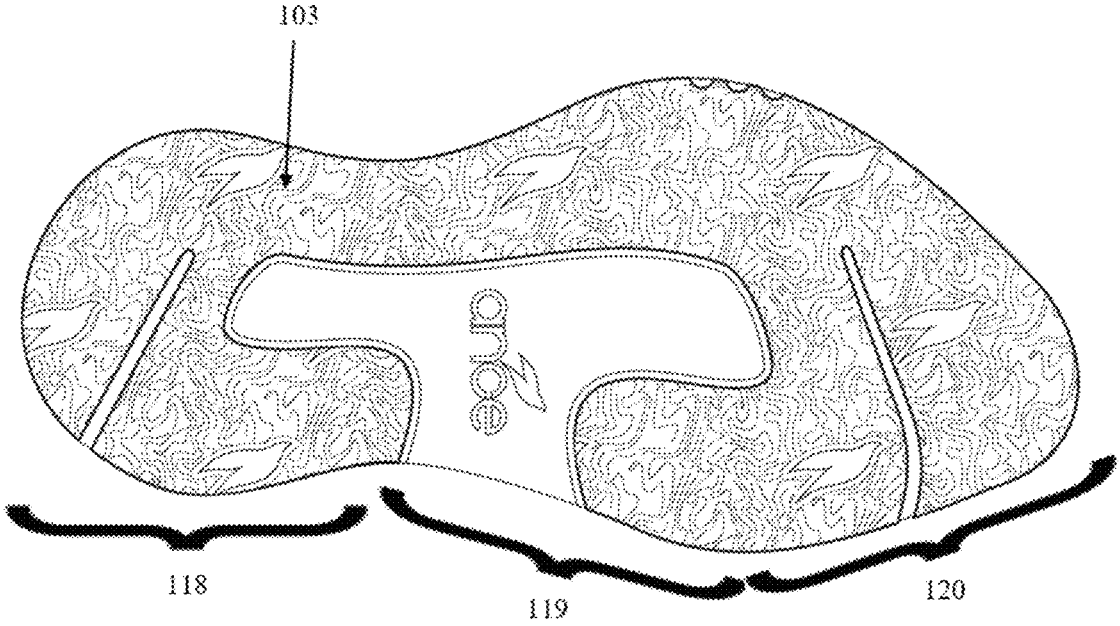
FIG. 1D is a bottom up view of the outsole of an embodiment of the present shoe.

For example, as shown in FIG. 1B, the strap is adapted to wrap around the inner portion of the foot, pass beneath the tongue portion 106 and across the top of the foot and secure to the shoe, such as by hook and loop fasteners (not shown). A tab 108, such as a chord or filament loop, may be integrated with or affixed to the distal end of the strap to assist in moving, securing, or releasing the strap. In other embodiments, the strap is secured to the medial side of the insole rather than looping around the foot. Alternatively, traditional laces could be affixed to the top cover instead of the strap.

Figure 2A:
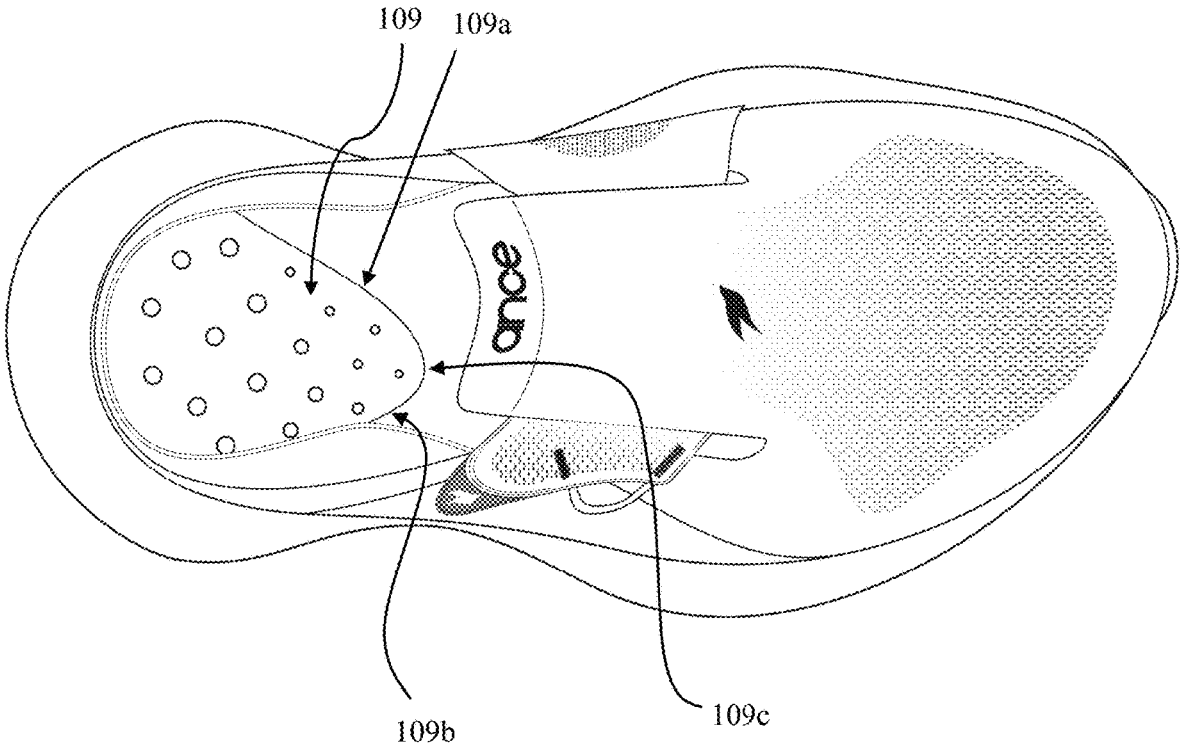
FIG. 2A is a top down view of an embodiment of the present shoe with the foldable fold-down heel folded down.
Figure 2B:
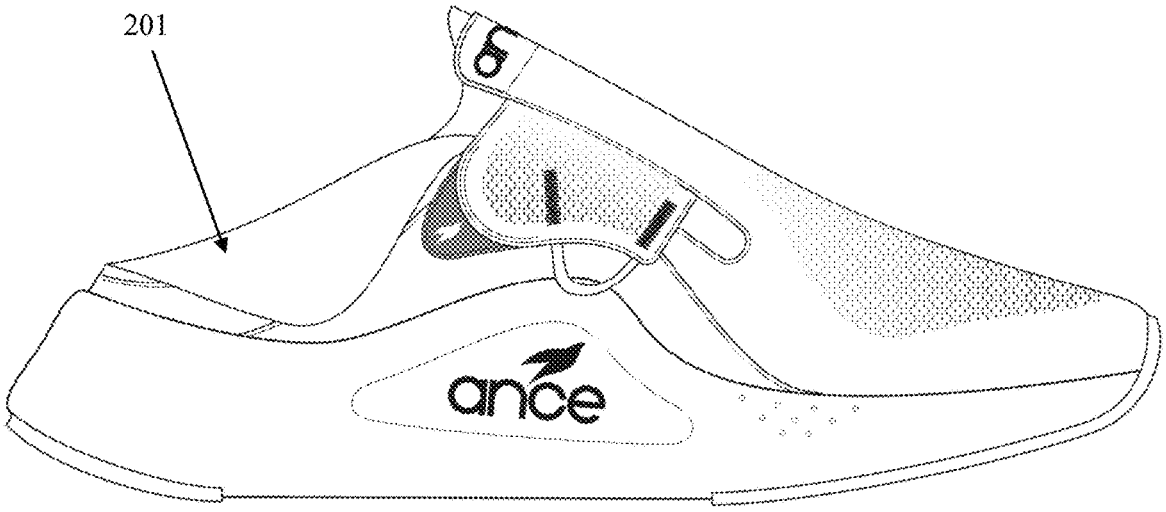
FIG. 2B is a side view of the right side of an embodiment of the present shoe with collars and fold-down heel folded down.
Figure 2C:
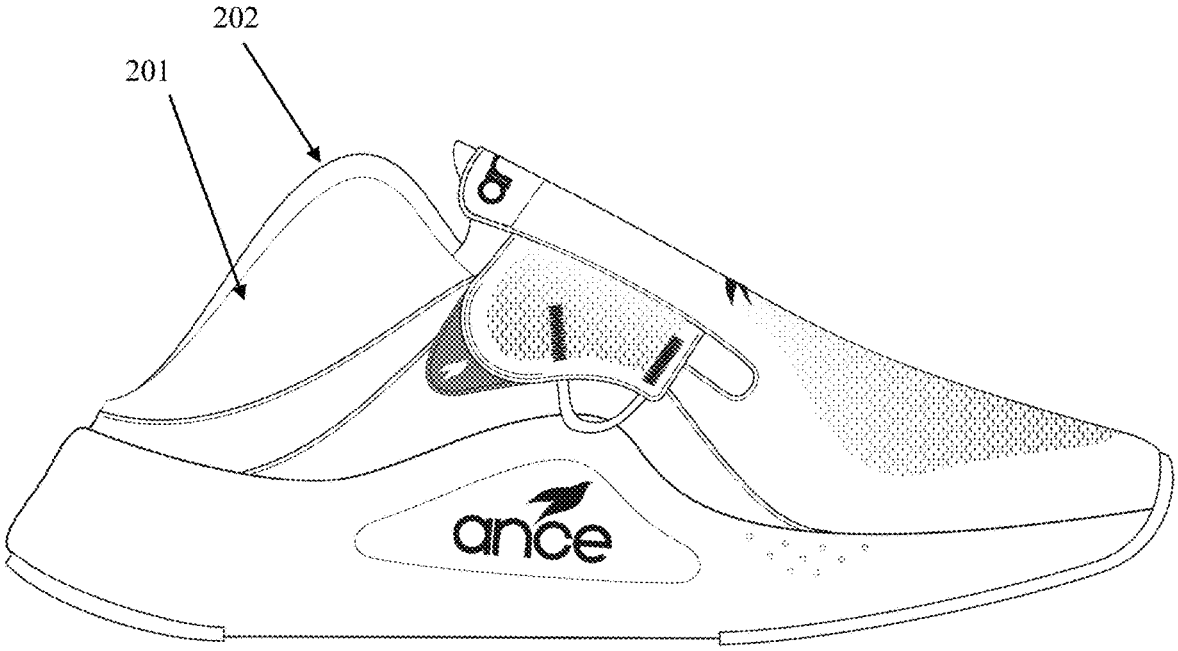
FIG. 2C is a side view of the right side of an embodiment of the present shoe with collars folded up and the foldable fold-down heel folded down.
Figure 2D:
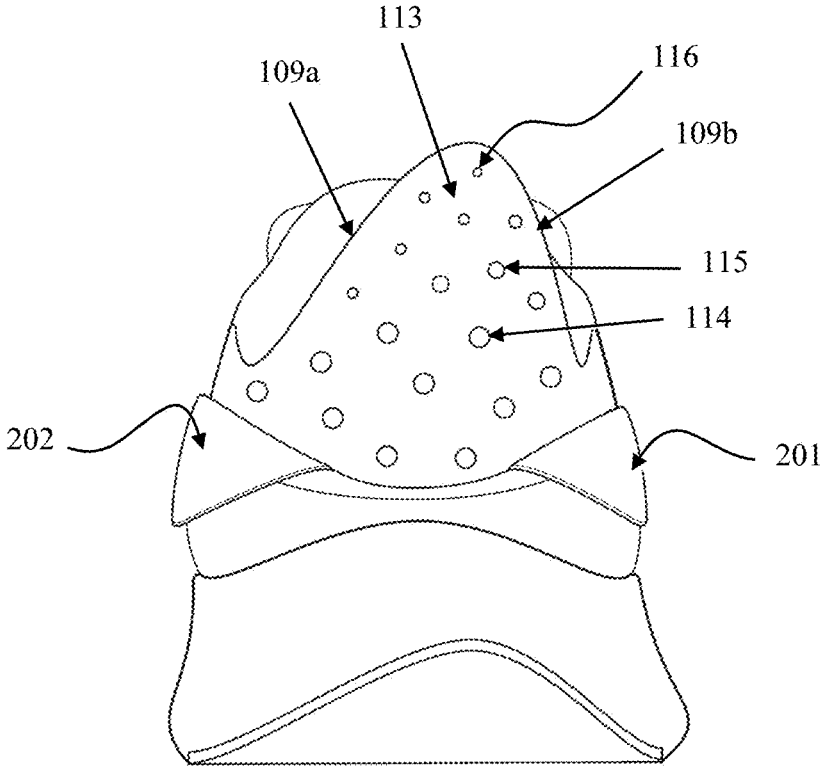
FIG. 2D is a back view of an embodiment of the present shoe with the collars folded down and the foldable fold-down heel folded up.
Figure 2E:
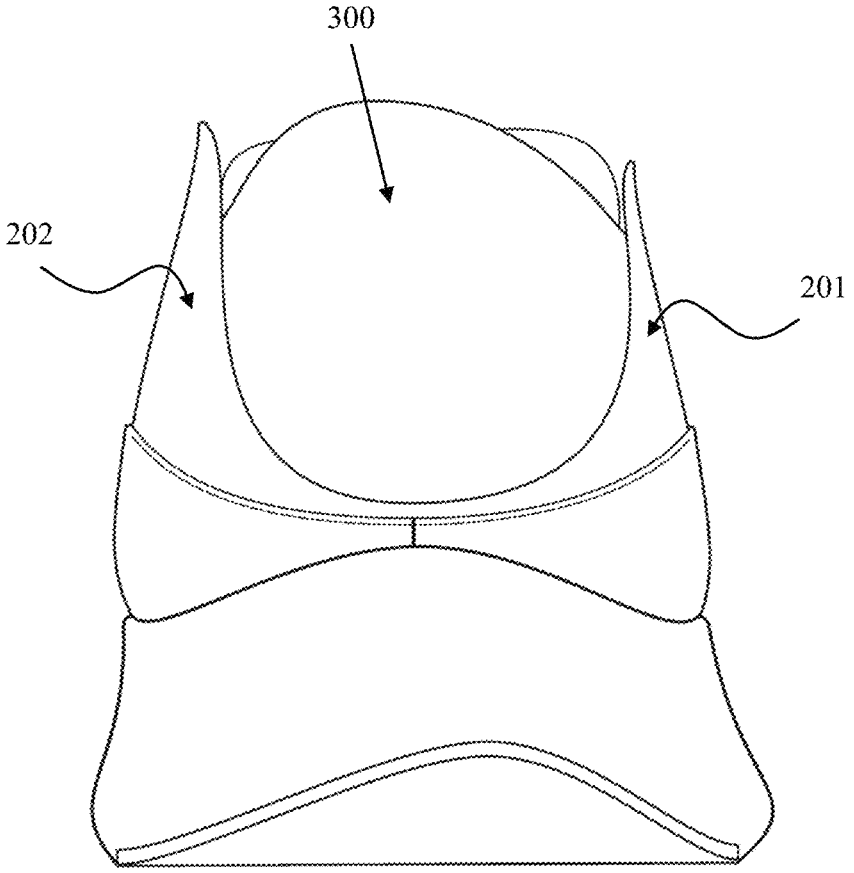
FIG. 2E is a back view of an embodiment of the present shoe with the collars folded up and foldable fold-down heel folded down.

The shoe further includes a flexible, fold-down heel 109. The fold-down heel is adapted to be repeatedly transitioned from an upright position (such as is shown in FIG. 1A) to a folded position (such as is shown in FIG. 2A-2C) without damaging the fold-down heel, upper, or mid-sole. The fold-down heel may be formed in an asymmetrical fold-down heel-like shape (meaning that the fold-down heel is asymmetrical about a vertically oriented plane that bisects the shoe longitudinally from the toe to the heel) for optimal anatomical coverage and therefore, benefit of the foot, especially as the athlete stands or walks. The fold-down heel may be formed such that it is asymmetrical (meaning that the fold-down heel is asymmetrical about a vertically oriented plane that bisects the shoe longitudinally from toe to heel). As shown, for example, in FIGS. 2A and 2D, the fold-down heel 109 extends and includes an interior side 109*a* formed of a curve having a lesser slope along the majority of its length than the slope of the curve forming the exterior side 109*b* of the fold-down heel. The apex 109*c* is also offset from a bisecting center line of the shoe such that it is positioned toward the exterior side of the shoe. That structure ensures that, when the fold-down heel is folded into the shoe, such as in FIG. 2A, the fold-down heel extends further along the lateral portion of the foot, than it does on the medial portion of the foot. The base 110 of the heel may be secured to the upper or to the mid-sole. The fold-down heel further includes raised sides 109*a*, 109*b* that are free from the upper and mid-sole as shown in FIG. 2D. The free sides enable the heel to collapse into the interior of the shoe without distorting or damaging the sides of the upper. In one embodiment, the midsole is formed of a soft, flexible fabric and is integrated with the upper so as to form a single, slipper-like structure. A sole may optionally be attached as well.

The exterior surface 113 of the fold-down heel 109 may include intermittently placed acupressure protrusions, see points 114, 115, 116 for example. These protrusions are three-dimensional and may vary in size and placement to provide relief to sore heels and tight plantar fascia as it stimulates blood flow to the foot. The fold-down heel 109 of the present shoe is configured to repeatedly fold down and up so that the user can use the shoe in a slip-on type capacity, walking on the folded down heel, or wear the shoe in a traditional manner, with the fold-down heel 109 raised up and cupping the wearer's heel.

Figure 3A:
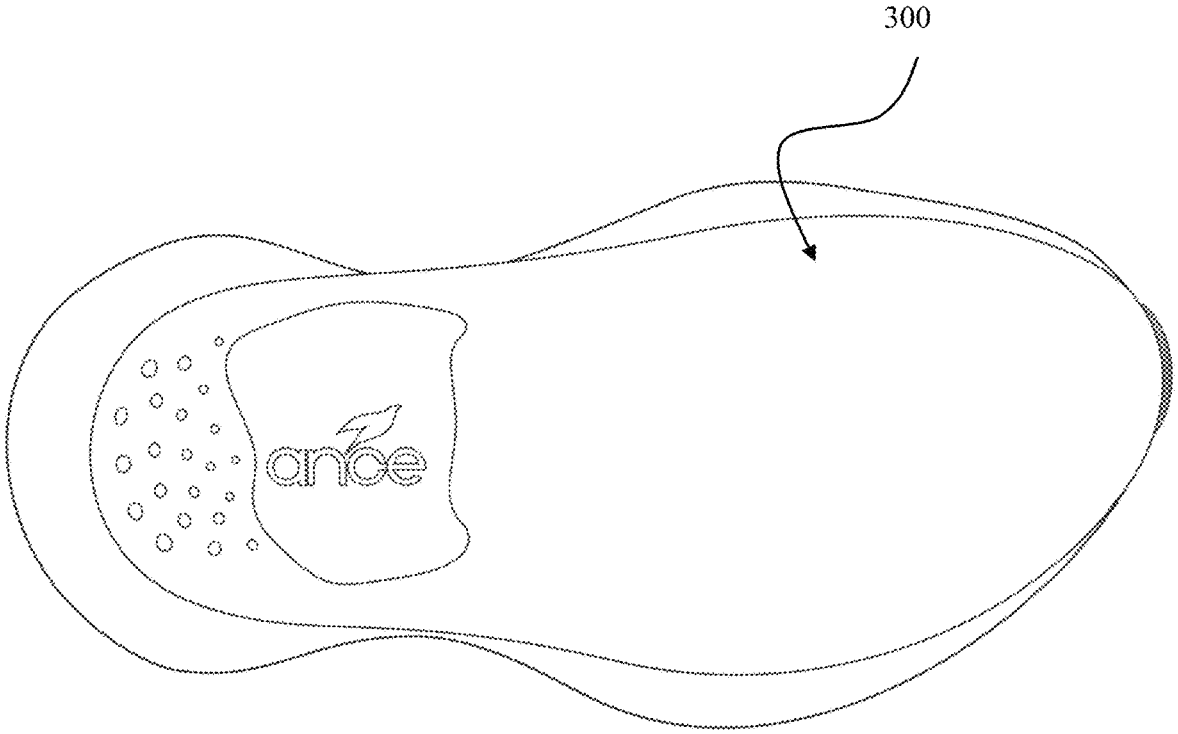
FIG. 3A is a top down view depicting the interior base layer of an embodiment of the present shoe.
Figure 3B:
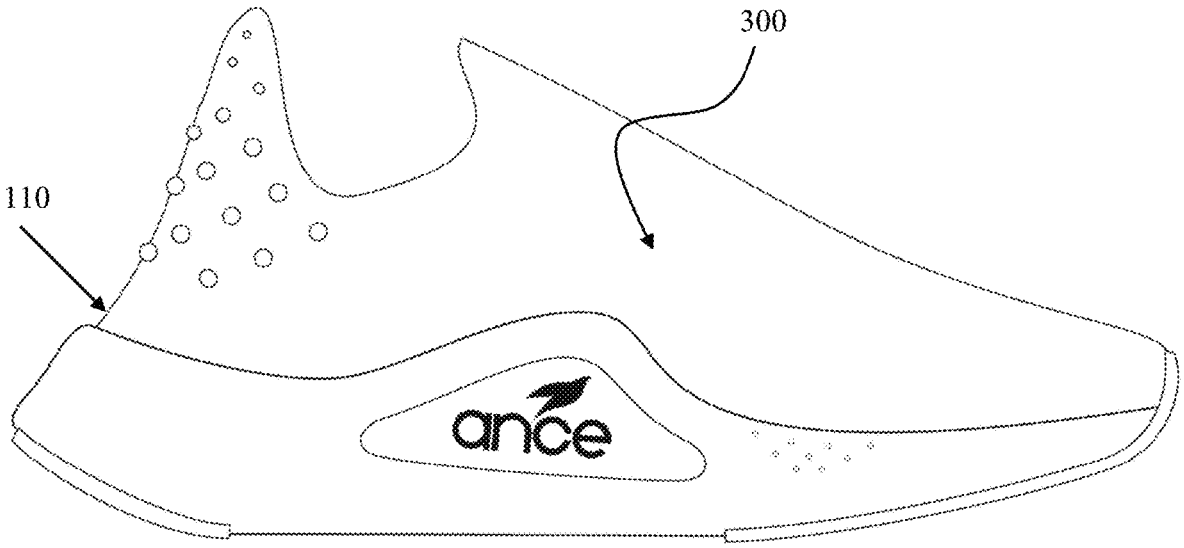
FIG. 3B is a side view depicting the interior base layer of an embodiment of the present shoe.

The heel may be formed integrally with a portion of the upper, such as is shown in FIG. 3. FIG. 3 is a depiction of a base layer 300 of the upper. The base layer may be formed of a knit or woven material, for example a jacquard fabric that is shaped to surround at least the fore foot and maintain the shoe in contact with the wearer.

As noted, the heel portion includes a fold-down heel 109 that extends up from the mid-sole and base layer 300. In one embodiment the acupressure points (e.g. 114, 115, 116) are placed in an asymmetrical fold-down heel-like shape for optimal anatomical coverage and therefore, benefit of the foot, especially as the athlete stands or walks. The asymmetrical fold-down heel structure allows the heel portion to collapse under the heel and mimic the curving shape of the sole of a foot. For example, the right foot heel follows the curve of the right foot inward going right to left, while the left foot heel follows the curve of the left foot inward going left to right.

In one embodiment, the acupressure points are on the back of a heel that is adapted to fold down. This provides the option to the athlete to collapse the shoe heel and rest their foot on the acupressure points for relief, when needed. The fold-down heel embodiment also allows the athlete to wear the shoe when the shoe is in a traditional configuration (as shown in FIGS. 1A and 1B, for example) or as a slide or sandal (as shown in FIGS. 2A and 2B, for example). As shown in FIG. 2B, the fold-down heel has been folded down, and thus cannot be seen, and side collars 201, 202 are folded down as well. When the fold-down heel is collapsed to rest beneath the heel of the foot (See FIG. 2A) it also provides relief to the back of the often raw/blistered heel and over-stressed Achilles tendon that might get further irritated by footwear with a rigid rear heel counter.

The acupressure points may be formed of semicircular domes, generally 0.05 inches to 0.5 inches in diameter. However, larger or smaller acupressure points could be utilized, and they could be formed of alternative shapes or a mix of shapes, such as a mix of ribs and domes.

In one embodiment, while the fold-down heel may not entirely collapse, there may be a separate layer inside the shoe that could be a full or partial length acupressure pad in the heel to mid-foot area of the shoe that may be collapsed to sit on top of the heel bed. The separate fold-down heel portion may or may not be of asymmetrical shape. The acupressure points in this embodiment may be of any size and shape, and anatomically placed to provide the most relief for the heel. In one embodiment, the acupressure points are varied in size. They may be arranged to form a pattern to provide differing levels of acupressure across the fold-down heel. It has been found to be desirable to have larger points located where the heel bone compresses the heel portion, while smaller points may be arranged around the heel bone and taper in size toward the plantar fascia and lateral plantar fascia as shown, for example, in FIG. 2A.

Some embodiments may include foldable collar flaps 201, 202. The foldable collar flaps provide the athlete the option to fold down the collar. For example, in FIG. 2B both the collar flaps 201 and 202 (not visible in FIG. 2B) are folded down as is the fold-down heel 109 (not visible in FIG. 2B) to minimize any irritation to often raw/blistered or otherwise stressed ankles. The folded down collars also allow ease of entry for the athlete to slide into the shoe more conveniently. When the collars 201, 202 and heel 109 are in the upright position, they collectively form a flexible heel counter that, together with the top cover, encircle a wearer's foot similar to a traditional shoe. However, when the collars and heel are folded down, the shoe may be slipped on and the heel and ankle of a wearer may be left exposed.

The main body of each collar flap is separate from the fold-down heel so as to move independently from the fold-down heel. The flaps are connected to the body of the upper. The body of the upper provides greater structural support to the upper than the flaps. The flaps may be of similar material and flexibility as the fold-down heel and can be independently folded outward over the outside of the upper. By folding the flaps outward, the wearer is able to limit contact of the shoe upper with the side of the wearer's heel (such as in the area of the superior peroneal retinaculum and lateral malleolus).

In one embodiment the side collars are not foldable and look more like a traditional shoe. Alternatively, the sides of the upper may be extended up and the collars may be eliminated so as to provide more structural support to the shoe when in sandal form, rather than providing the alleviation of stress that is accomplished through the utilization of the foldable collars.

The top portion 104 aids in the application of compression therapy to the foot of the wearer including arch support while also relieving stressed plantar fascia. It is a cohesive system that wraps around and hugs the mid foot, providing much-needed compression to overused feet.

In one embodiment the strap 107 of the top portion 104 can be tightened or loosened based on the preference of the user. In another embodiment, strap is not present as a removable strap but rather is integrated with the upper so as to always provide compression in the form of a band that encircles the foot of the wearer. The strap (or band) passes beneath the insole, and is independent from the insole such that it is adapted to move independently from the insole. In one embodiment, the top portion 104 covers the fore foot; the strap 107 wraps around the entire mid-foot or mid-sole area, starting from the lateral side, through to the medial side and wrapping around back to the lateral side. The strap may be fastened to the upper using a fastener (such as Velcro, button or other fasteners suitable for repeated engagement and disengagement).

Figure 5A:
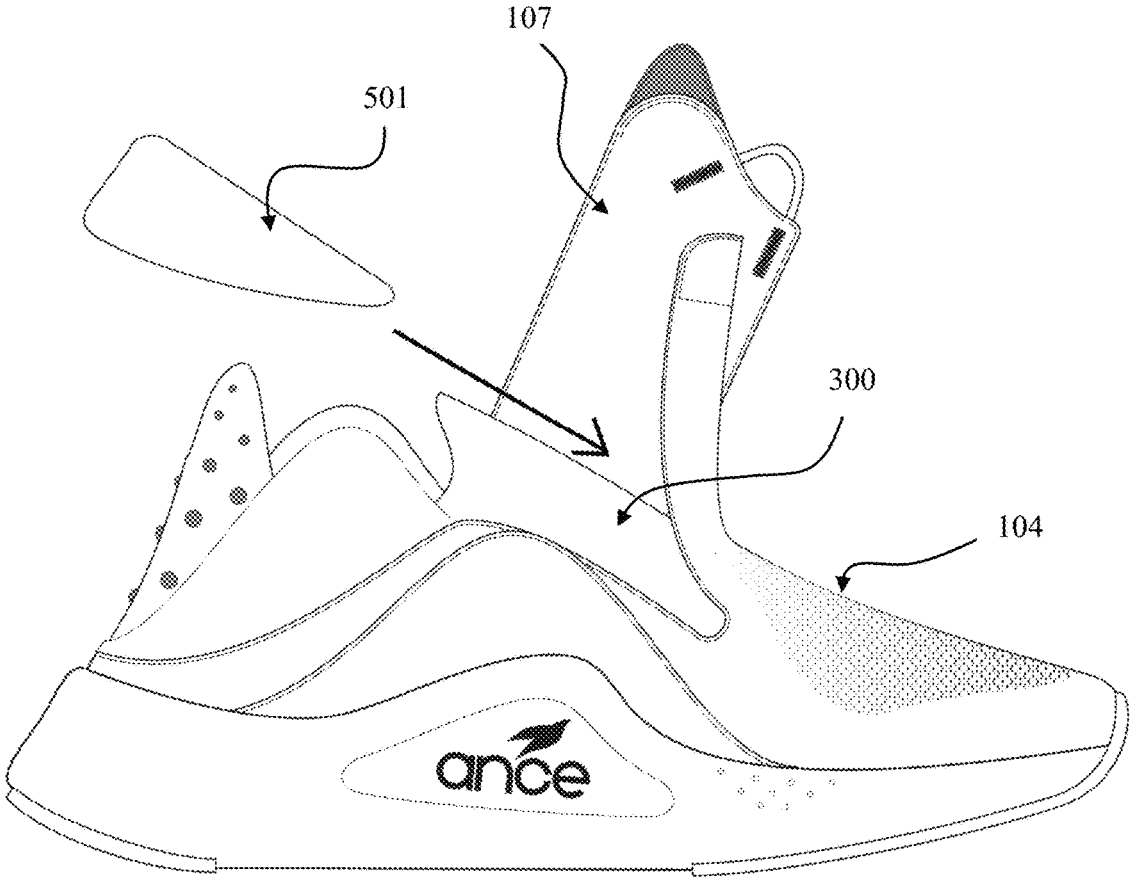
FIG. 5A is a depiction of the insertion of a thermal pack into a toe box pocket of an embodiment of the present shoe.
Figure 5B:
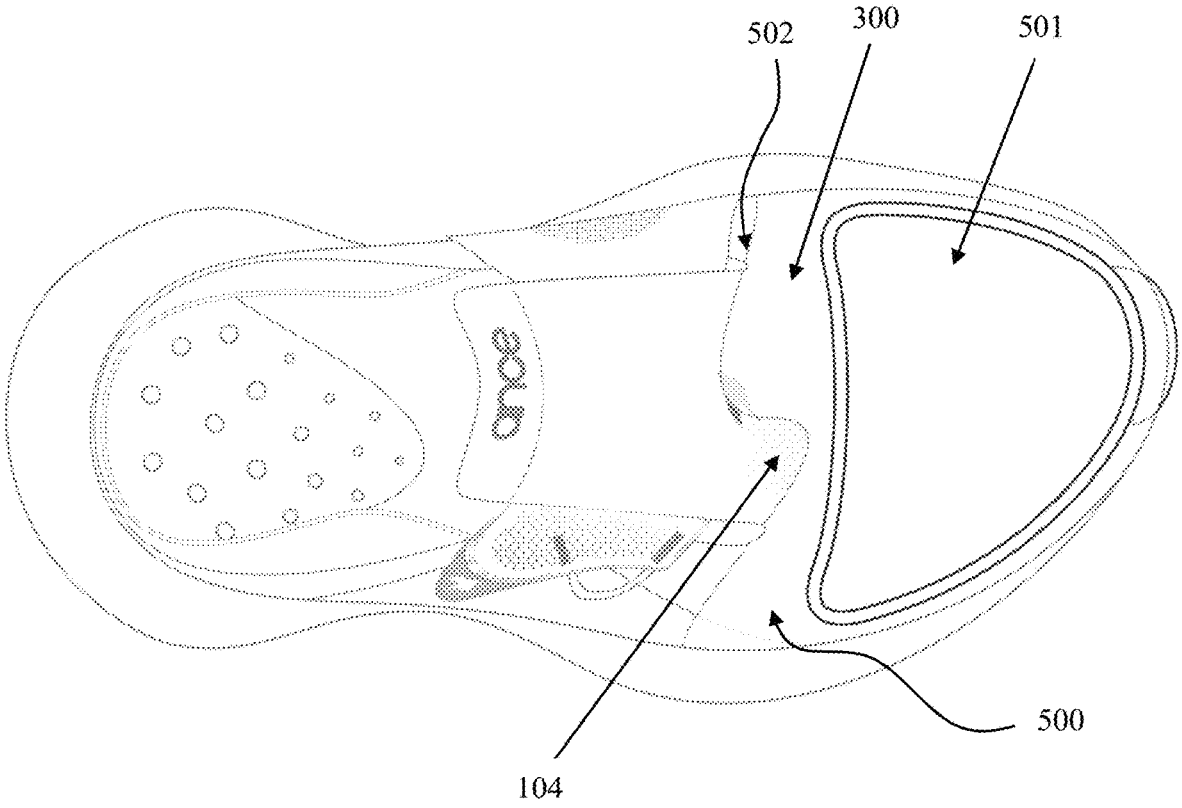
FIG. 5B is a depiction of an embodiment of the present shoe with a portion of the toe box of the top cover cut away to show the thermal pack within the toe box pocket.

With reference to FIGS. 5A-5B, one embodiment may also provide a system for providing thermal (hot or cold) therapy. The shoe may allow for thermal packs to be placed on the forefoot (covering bottom and/or top of the foot) to provide relief to the over stressed forefoot, including metatarsals, toes and bunions. As shown in FIG. 3 the upper includes a base layer 300. Top cover 104 is affixed to the shoe such that the toe cover portion 105 is at least partially separated from the base so as to form a pocket between the top cover and the base layer. Lifting the tongue provides access to the pocket. FIG. 5B shows a cutaway (along imaginary cutaway line 502) of the cover portion showing an example of the general position of the pocket, generally referenced by numeral 500, formed between the top cover and the base layer. Thermal pack 501 is adapted to slide into and fit in the pocket 500. The pocket is designed to ensure that the thermal pack remains in a fixed position with respect to the shoe upper to maintain therapy even as the foot moves, such as while a wearer walks.

In one embodiment, the upper of the shoe, from the toe cap all the way to the tongue is dual layered (See FIGS. 3 (layer 1) and 4, 5A (layer 2)), forming the pocket. The pocket allows the athlete to insert thermal pack (such as a heat pack or ice pack) to provide relief to the over-stressed metatarsals, toes and bunions. As shown in 5B, a portion of the toe cover portion 105 of the top cover portion 104 is cut away to show the pocket (which may extend further up the shoe toward the tongue). The receptacle is designed to ensure that the thermal pack remains in a fixed position with respect to the upper regardless of any movement of the foot. For example, the securing strap 107 lifts up and away from the base layer 300 to expose the entry of a pocket formed in the toe box of the shoe. In one embodiment the thermal pack could extend up and under the tongue as well or be sized so as to form around the sides of the foot and extend along the sides of the base layer 300 as well.

In some embodiments, the forefoot of the shoe is substantially wider than the rest of the shoe. Often athletes (especially, dancers and skaters) squeeze their feet into very narrow shoes. Too tapered of shoes leads to excess discomfort on the feet and often cause bunion issues, incessant corns, and bruised toenails. The present shoe provides a wide toe-box allows for splaying of the foot and thus ergonomic placement. For example, the ratio of the width of toe box to the width of the heel is exaggerated as compared to the ratio of the same size running shoe, which allows wearer's toes to spread out inside the shoe as the wearer stands or walks. This promotes circulation, allowing much needed relief and comfort to the feet. The wide toe-box also allows the athlete to comfortably wear toe separators/spacers that further remove pressures and align the toes where they need to be.

Additionally, the present shoe may exhibit a minimal heel drop in the outsole of between 0 mm to 16 mm, and more specifically 6 mm-16 mm from the heel to the ball of the foot. The minimal heel drop along with the additional features as mentioned above provides further relief and recovery benefits. The minimal-drop enables the foot to sit in a natural position with stretched out Achilles tendon, thus strengthening the foot, which helps wearer's spine alignment and posture. The minimal heel drop, therefore is part of the entire relief system of the shoe.

Although the present apparatus and system has been described in terms of various embodiments, it is to be understood that such disclosure is not intended to be limiting. Various alterations and modifications will be readily apparent to those of skill in the art. Accordingly, it is intended that the appended claims be interpreted as covering all alterations and modifications as fall within the spirit and scope of the invention.

What is claimed is:

1. A shoe comprising:

a mid-sole having a heel portion, a mid-foot portion, and a toe portion, a base layer having a heel, and a top cover, the mid-sole, base layer and top cover together forming a shoe;

wherein the heel comprises a flexible fold-down heel connected to the mid-sole and adapted to be repeatedly transitioned from an upright position to a folded position wherein the fold-down heel is asymmetrical about a vertically oriented plane that bisects the shoe longitudinally from a toe to the heel.

2. The shoe of claim 1 wherein, when the fold-down heel is folded down into the shoe, the fold-down heel extends further along the portion of the shoe corresponding to the lateral portion of a foot than it does on the portion of the shoe corresponding to the medial portion of the foot.

3. The shoe of claim 1 wherein the fold-down heel includes a plurality of acupressure protrusions.

4. The shoe of claim 3 wherein the acupressure protrusions are arranged in an asymmetrical pattern such that a greater density of protrusions are positioned proximally to the exterior side than the interior side.

5. The shoe of claim 3 wherein the acupressure protrusions include semicircular domes between 0.05 inches and 0.5 inches in diameter.

6. The shoe of claim 1 wherein the top cover comprises: a toe cover portion, a tongue, and a strap having proximal end, a distal end, and a middle portion extending between the proximal end and distal end, wherein the proximal end is connected a lateral side of the shoe while the middle portion a distal end are not connected to the shoe, and wherein the middle portion of strap is adapted to extend from proximal end on the lateral side of the shoe, pass beneath an insole of the shoe, wrap around an inside portion of the shoe, and may be fastened to the shoe over or beneath the tongue by a fastener.

7. The shoe of claim 1 wherein the top cover is separated from the base layer such that a toe cover portion of the top cover and the base layer form a pocket proximal to the toe portion.

8. The shoe of claim 7 further comprising a thermal pack positioned within the pocket.

9. A shoe comprising:

a mid-sole having a heel portion, a mid-foot portion, and a toe portion, a base layer having a heel, and a top cover, the mid-sole, base layer and top cover together forming a shoe;

wherein the heel comprises an asymmetrical flexible fold-down heel having an exterior side and interior side and that is adapted to be repeatedly transitioned from an upright position to a folded position and having a base connected to the mid-sole.

10. The shoe of claim 9 wherein the top cover comprises: a toe cover portion, a tongue, and a strap, the strap being adapted to extend from a distal end of the strap connected at an exterior side of the shoe, pass beneath an insole of the shoe, wrap around an inside portion of the shoe, and secure over or beneath the tongue.

11. The shoe of claim 9 wherein the top cover is separated from the base layer such that a toe cover portion of the top cover and the base layer form a pocket proximal to the toe portion.

12. The shoe of claim 11 further comprising a thermal pack positioned within the pocket.

13. The shoe of claim 9 wherein the fold-down heel includes a plurality of acupressure protrusions.

14. The shoe of claim 13 wherein the acupressure protrusions are arranged in an asymmetrical pattern such that a greater density of protrusions are positioned proximally to the exterior side than the interior side.

15. A shoe comprising:

a mid-sole having a heel portion, a mid-foot portion, and a toe portion, a base layer having a heel, and a top cover, the mid-sole, base layer and top cover together forming a shoe;

wherein the heel comprises a flexible fold-down heel adapted to be repeatedly transitioned from an upright position to a folded position and having a base connected to the mid-sole, an apex, an interior side, an exterior side, and plurality of acupressure protrusions wherein the interior side and exterior side extend from the apex.

16. The shoe of claim 15 wherein the apex, interior side, and exterior side of the fold-down heel are together asymmetrical about a vertically oriented plane that bisects the shoe longitudinally from a toe to the heel.

17. The shoe of claim 15 wherein the acupressure protrusions are arranged in an asymmetrical pattern such that a greater density of protrusions are positioned proximally to the exterior side than the interior side.

18. The shoe of claim 15 wherein the acupressure protrusions include semicircular domes between 0.05 inches and 0.5 inches in diameter.

19. The shoe of claim 15 wherein the top cover comprises: a toe cover portion, a tongue, and a strap, the strap being attached to the shoe only at an exterior side of the shoe and being adapted to wrap around an inside portion of the shoe, and fasten to the shoe over or beneath the tongue.

20. The shoe of claim 15 wherein the top cover is separated from the base layer such that a toe cover portion of the top cover and the base layer form a pocket proximal to the toe portion.

21. The shoe of claim 20 further comprising a thermal pack positioned within the pocket.

* * * * *